US005481062A

United States Patent [19]

Lamnevik

[11] Patent Number: 5,481,062

[45] Date of Patent: Jan. 2, 1996

[54] METHOD OF DESTROYING EXPLOSIVE SUBSTANCES

[75] Inventor: Stefan Lamnevik, Ersta, Sweden

[73] Assignee: Forsvarets Forskningsanstalt, Sundbyberg, Sweden

[21] Appl. No.: 295,689

[22] PCT Filed: Feb. 26, 1993

[86] PCT No.: PCT/SE93/00171

§ 371 Date: Aug. 25, 1994

§ 102(e) Date: Aug. 25, 1994

[87] PCT Pub. No.: WO93/17295

PCT Pub. Date: Sep. 2, 1993

[30] Foreign Application Priority Data

Feb. 26, 1992 [SE] Sweden ..... 9200576

[51] Int. Cl.[6] ..... C06B 21/00

[52] U.S. Cl. ..... 588/203; 110/344; 110/345

[58] Field of Search ..... 588/202, 203; 110/237, 345, 344, 346; 149/124

[56] References Cited

U.S. PATENT DOCUMENTS 3,916,805 11/1975 Kalfadelis et al. ..... 110/345

4,231,822 11/1980 Roth ..... 149/109.6

4,425,170 1/1984 Jones ..... 149/109.6

5,211,777 5/1993 Nahlovsky et al. ..... 149/109.6

FOREIGN PATENT DOCUMENTS 0349865 1/1990 European Pat. Off. .

4041744 10/1991 Germany .

*Primary Examiner*—Ngoclan Mai

*Attorney, Agent, or Firm*—Jacobson, Price, Holman & Stern

[57] ABSTRACT

The invention relates to a method of destroying explosive substances in which the explosive substances are converted to a pumpable liquid or suspension which is not detonatable but combustible and which can be burned in conventional boilers intended for energy production. The explosive substance is dissolved or suspended in a combustible liquid which contains no available oxygen or only a small amount of available oxygen, preferably fuel oil, wherein the amount of liquid present is so large as to reduce the energy content of the mixture to 1 MJ/kg or less in the absence of available atmospheric oxygen. The mixture is burned in a combustion apparatus, by delivering the mixture to the combustion apparatus via a liquid fuel burner or a burner for solid fuel/liquid fuel suspensions. The grain size of the explosive substance in suspension is selected so that each grain will be incinerated during its residence time in the flame of the burner concerned.

10 Claims, No Drawings

METHOD OF DESTROYING EXPLOSIVE SUBSTANCES

The present invention relates to a method of destroying explosive substances, and more specifically to a method of destroying explosive substances by combustion in a combustion apparatus.

Large quantities of supernumerary, out-of-date and functionally deficient or otherwise unusable ammunition are destroyed each year. The quantities concerned are significant and constitute several hundreds to several thousands of tonnes per year and nation. Earlier, ammunition was dumped in lakes or oceans, or exploded or burned in the open air on firing ranges or the like. It is no longer permitted to dump ammunition in lakes or oceans. Destroying by explosive processes on a large scale requires extensive safety distances, among other things because of the noise that is generated thereby, therewith placing a geographic limitation on the use of this method. Similar to explosive processes, the burning of explosive substances in the open air releases reaction products which are environmentally harmful, for instance such products as carbon monoxide and nitrogen oxides.

Attempts have earlier been made to incinerate explosive substances in a solid form (lumps) in furnaces, such as cement kilns, which although enabling the flue gases to be cleaned also incurs the risk of explosion due to agglomeration of explosive substances. Furthermore, when the explosive substances are charged to the furnace in a solid state, it is difficult to control the flow of explosive substances in a manner which will enable the flue gases to be cleaned effectively. The handling of solid explosive substances, in powder or lump form, is also combined with the risk of explosion.

An object of the present invention is to destroy explosive substances by incineration in a combustion apparatus in a safe manner.

Another object of the invention is to destroy explosive substances by incineration in a manner which will enable the combustion gases to be cleaned effectively.

Yet another object of the invention is to destroy explosive substances by incineration in a manner which will enable the energy content of the explosive substances to be utilized.

These objects are achieved with an inventive method defined in the Claims.

The inventive method comprises dissolving or suspending the explosive substance in a combustible liquid which has no available oxygen or only a small amount of available oxygen, wherein the proportion of liquid used is so large as to reduce the energy content of the mixture to 1 MJ/kg or less in the absence of available atmospheric oxygen; and burning the mixture in a combustion apparatus by delivering the mixture to said combustion apparatus via a liquid fuel burner or a burner for solid fuel/liquid fuel suspensions. The mixture is delivered through the burner to a combustion chamber in the combustion apparatus in a finely-divided state and is combusted while generating a controlled flame. The mixture can thus be used as a fuel for this type of burner and the explosive substance is incinerated as an integral part of the fuel.

This method of incinerating the explosive substance in a fluid form, through the agency of liquid or suspension burners enables the flow of explosive substances in the combustion zone to be monitored and controlled in an effective manner, which is essential both from the aspect of safety and from an environmental aspect. The combustion process can be controlled with regard to the generation of harmful combustion products and can be guided, for instance, with regard to a subsequent cleaning of the flue gases with a catalytic reduction of nitrogen oxides. One known method of chemically reducing nitrogen oxides in industrial flue gases involves, for instance, adding a reducing agent (ammonia) to the flue gases and bringing the mixture into contact with a catalyst bed. The flows of material in the combustion process must be effectively controlled in order for such a method to function efficiently, a requirement which is satisfied by the present invention.

When combusted with air, the explosive substances have combustion energies of between about 5 and 15 MJ/kg. According to the inventive method, the explosive substances are converted to a pumpable, nondetonatable but combustible fluid which can be burned safely in conventional boilers for energy production. This enables the energy content of the explosive substances to be recovered and utilized.

The burners used may be conventional burners, such as fuel oil burners or burners for liquid fuel suspensions, for instance powdered coal suspensions, i.e. burners which inject finely-divided fuel into the combustion appliance. Different methods of finely-dividing the fuel are known with this type of burner, for instance steam atomizing, high pressure air atomizing, low pressure air atomizing, with the aid of spray nozzles or rotary mechanical atomizers.

Any type of combustible liquid which contains no available oxygen or only a small amount of available oxygen, can be used as a liquid for dissolving or suspending the explosive substance. The ability of an explosive substance to explode is primarily determined by its chemical composition and then particularly by its balance between oxygen and other elements. By adding a sufficiently large quantity of other elements which displace the oxygen balance of the explosive substance sufficiently towards the oxygen lean direction, the resultant mixture is no longer able to detonate. Such substances include, for instance, liquid combustibles which have no intrinsically available oxygen. The substance shall thus lack oxygen bound as peroxide, nitro-group, nitrate-group, nitramine-group, etc. Suitable combustible liquids are hydrocarbons, alcohols, ketones, esters and mixtures thereof. Fuel oil is particularly preferred, wherein both light and heavy fuel oil can be used. An homogenous mixture can be obtained with a liquid which dissolves the explosive substance or a liquid in which the explosive substance can be suspended. In the case of liquid suspensions, it is necessary for the particles of explosive substance to be sufficiently small and to be kept suspended, e.g. by agitating or by thickening the liquid. Heavy fuel oil or so-called thick oil is particularly suited to the production of suspensions, due to the viscosity of the liquid.

It has been found in accordance with the invention that a suitable ratio of explosive substance to liquid is one in which the energy content of the mixture lies at 1 Mj/kg or less in the absence of available atmospheric oxygen. In the case of trotyl (trinitrotoluene) and fuel oil for instance, this energy content is obtained with a mixture containing at least 65 percent by weight oil.

When burning a suspension, the largest particle size of the explosive substance is selected so small that each individual grain will be incinerated in the flame, i.e. the particle size is adapted to the residence time of the explosive particles in the flame, which is determined by the size of the burner, and the deflagration rate of the specific explosive substance at atmospheric pressure. In the case of trotyl, for instance, a residence time of 0.1 seconds requires a largest particle size of about 0.2 mm.

A particle size within the range of 0.05–0.5 mm has been found suitable for the majority of explosive substances and burners.

The solution or suspension is combusted in a combustion apparatus with a regulated quantity of air. According to one embodiment of the invention, there is used a combustion apparatus which is connected to a boiler for energy production, preferably to a high power boiler, i.e. a boiler of the kind typically found in boiler plants for district heating systems and the like, and provided with fuel oil burners, coal suspension burners or the like. These boiler plants are also normally provided with flue gas cleaning devices, so as to enable the explosive substances to be incinerated in a manner which is environmentally acceptable.

The explosive substances that can be destroyed in accordance with the invention include propellants, blasting agents and pyrotechnical compositions.

Conventional propellants and blasting agents contain the elements carbon, hydrogen, oxygen and nitrogen. Some blasting agents also contain metal powder, primarily aluminium. The normal products of combustion are carbon dioxide, water, gaseous nitrogen and, for aluminium containing explosives, aluminium oxide. Minor quantities of nitrogen oxides, carbon monoxide and carbon (soot) are also obtained.

The solid substances in the combustion gases (aluminium oxide and soot) can be taken care of with the aid of dust filters, for instance coarse filters and electrofilters. Condensible and water-soluble compounds can be separated from the resultant gases, by total condensation and washing in scrubbers. Re-condensation of the water vapour will also provide a higher heat yield and water for the gas wash. Nitrogen oxides and carbon monoxide can be converted to gaseous nitrogen and carbon dioxide respectively in catalyst beds. All of these gas purifying methods are well known to those skilled in the cleansing of industrial flue gases, and equipment of this kind is already used in many large boiler plants.

In some instances, pyrotechnical mixtures in smokeforming ammunition, recognizance flares and incendiary ammunition will contain compounds which require special measures to be taken when cleaning the resultant flue gases, and it may be necessary to control the combustion temperature with a view of the formation of dioxin, for instance when incinerating smoke ammunition that contains hexachloroethane/zinc.

I claim:

1. A method of destroying explosive substances, characterized by dissolving or by suspending the explosive substance in a combustible liquid which has no available oxygen or only a small amount of available oxygen, wherein the proportion of liquid used is so large as to reduce the energy content of the mixture to 1 MJ/kg or less in the absence of available atmospheric oxygen; and burning the mixture in a combustion apparatus by delivering the mixture to said combustion apparatus via a liquid fuel burner or a burner for solid fuel/liquid fuel suspensions.

2. A method according to claim 1, characterized by selecting the liquid from a group consisting of hydrocarbons, alcohols, ketones, esters and mixtures thereof.

3. A method according to claim 2, characterized in that the liquid is fuel oil.

4. A method according to claim 3, characterized in that the fuel oil is so-called heavy fuel oil.

5. A method according to claim 1, characterized by selecting the particle size of the explosive substance so that each individual grain will be incinerated during its residence time in the flame of the burner concerned, when a suspension of the explosive substance in the liquid is prepared.

6. A method according to claim 5, characterized in that the grain size is 0.05–0.5 mm.

7. A method according to claim 1, characterized in that the combustion apparatus is connected to a boiler for energy production.

8. A method according to claim 1, characterized in that the combustion apparatus is connected with a flue gas cleaning facility.

9. A method according to claim 8, characterized in that the flue gas cleaning facility includes catalytic conversion of nitrogen oxides.

10. A method according to claim 8, characterized in that the flue gas cleaning facility includes catalytic conversion of carbon monoxide.

* * * * *